US008197056B2

(12) United States Patent
Furukawa

(10) Patent No.: US 8,197,056 B2
(45) Date of Patent: Jun. 12, 2012

(54) IMAGE FORMING APPARATUS HAVING LINE-TYPE RECORDING HEAD

(75) Inventor: Juichi Furukawa, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 1008 days.

(21) Appl. No.: 12/019,484

(22) Filed: Jan. 24, 2008

(65) Prior Publication Data

US 2008/0180507 A1 Jul. 31, 2008

(30) Foreign Application Priority Data

Jan. 26, 2007 (JP) ..... 2007-015893

(51) Int. Cl.
*B41J 2/01* (2006.01)

(52) U.S. Cl. ..... 347/104; 347/101

(58) Field of Classification Search ..... None
See application file for complete search history.

(56) References Cited

U.S. PATENT DOCUMENTS

| | | | | |
|---|---|---|---|---|
| 2004/0160475 | A1* | 8/2004 | Satoh et al. | 347/36 |
| 2004/0183850 | A1* | 9/2004 | Takeuchi et al. | 347/19 |
| 2005/0012798 | A1 | 1/2005 | Adachi et al. | |
| 2005/0174411 | A1 | 8/2005 | Adachi et al. | |
| 2005/0185015 | A1* | 8/2005 | Yakura et al. | 347/29 |
| 2006/0057339 | A1 | 3/2006 | Adachi et al. | |
| 2006/0061643 | A1 | 3/2006 | Furukawa et al. | |
| 2006/0087530 | A1 | 4/2006 | Furukawa | |
| 2006/0203056 | A1 | 9/2006 | Furukawa et al. | |
| 2007/0058009 | A1 | 3/2007 | Furukawa et al. | |
| 2007/0273725 | A1 | 11/2007 | Furukawa et al. | |

FOREIGN PATENT DOCUMENTS

| | | |
|---|---|---|
| CN | 1519130 A | 8/2004 |
| JP | 2000-229747 | 8/2000 |
| JP | 2000-334951 | 12/2000 |
| JP | 2002-248819 | 9/2002 |
| JP | 2002-273878 | 9/2002 |
| JP | 3432052 | 5/2003 |
| JP | 2003-341158 | 12/2003 |
| JP | 2004-51234 | 2/2004 |
| JP | 2004-160952 | 6/2004 |
| JP | 2004-167802 | 6/2004 |

(Continued)

OTHER PUBLICATIONS

Jul. 17, 2009 Chinese official action in connection with a counterpart Chinese patent application No. 2008100085856.6. Feb. 17, 2012 Chinese official action in connection with a counterpart Chinese official action.

*Primary Examiner* — Matthew Luu
*Assistant Examiner* — Kendrick Liu
(74) *Attorney, Agent, or Firm* — Cooper & Dunham LLP

(57) ABSTRACT

An image forming apparatus includes a recording head, a conveyance member, and a guide member. The recording head includes a plurality of head units to discharge liquid droplets onto a recording medium, each of the plurality of head units having a plurality of nozzles through which liquid droplets are discharged. The conveyance member conveys the recording medium in a direction substantially perpendicular to a direction in which the plurality of head units are arranged. The guide member includes a plurality of ribs of at least two, first and second, types having different heights and is disposed opposite the recording head so as to guide the recording medium. The first type of ribs having a height greater than a height of the second type of ribs are disposed opposite areas where the plurality of head units overlap in the arranged direction thereof.

13 Claims, 16 Drawing Sheets

FOREIGN PATENT DOCUMENTS

| | | |
|---|---|---|
| JP | 2004-306578 | 11/2004 |
| JP | 2005-22318 | 1/2005 |
| JP | 2005-67052 | 3/2005 |
| JP | 2005-262832 | 9/2005 |
| JP | 2006-56047 | 3/2006 |
| JP | 4073008 | 2/2008 |

* cited by examiner

COMPARATIVE EXAMPLE 1

COMPARATIVE EXAMPLE 2

IMAGE FORMING APPARATUS HAVING LINE-TYPE RECORDING HEAD

CROSS-REFERENCE TO RELATED APPLICATION

The present patent application claims priority under 35 U.S.C. §119 from Japanese Patent Application No. 2007-015893, filed on Jan. 26, 2007 in the Japan Patent Office, the entire contents of which are hereby incorporated herein by reference.

BACKGROUND

1. Technical Field

This disclosure relates generally to an image forming apparatus, and more specifically, an image forming apparatus having a recording head in which a plurality of head units are arranged in a direction perpendicular to a conveyance direction of a recording medium.

2. Description of the Related Art

An image forming apparatus used as a printer, facsimile machine, copier, or multi-functional device thereof may have a liquid discharge device including a recording head configured as, for example, a liquid discharge head for discharging liquid droplets of a recording liquid, for example, ink. Such image forming apparatuses perform image formation by attaching liquid droplets onto a recording medium (hereinafter "sheet" or "sheets").

For such image forming apparatuses, various line-type recording heads have been developed to enhance printing speed. One conventional line-type recording head includes a plurality of head units, which may be called "head chips." Such head units include a plurality of nozzles arrayed in one or more rows in a given direction (hereinafter "nozzle array direction"). In such a line-type recording head, for example, the plurality of head units may be staggered in a direction perpendicular to a conveyance direction of a sheet so that the nozzle array direction in each of the head units is perpendicular to the sheet conveyance direction.

Alternatively, the plurality of head units may be inclined with respect to the sheet conveyance direction so that a nozzle array direction in each head unit is inclined at a certain angle to the sheet conveyance direction.

For example, in one conventional line-type recording head, a plurality of head units are arranged so that adjacent head units overlap by, for example, several nozzles in a direction perpendicular direction to a sheet conveyance direction. Alternatively, a plurality of head units may be arranged so that end columns of nozzles of adjacent heads overlap in the direction perpendicular direction to the sheet conveyance direction.

Such line-type recording heads may include a plurality of head units having a relatively short length. Accordingly, such line-type recording heads may be manufactured at a relatively high yield and thus at a relatively low cost compared to a single long head in which the width of a nozzle array is greater than the width of a sheet.

However, for such a configuration, in a border area in which liquid droplets discharged from adjacent head units are joined together in an image, deviation in landing positions of the liquid droplets may show up as white or black streaks, thereby degrading image quality.

Hence, in order to prevent such white or black streaks due, for example, to thermal expansion of the recording head, one conventional line-type recording head includes a plurality of head units, in each of which a plurality of nozzle arrays are staggered so as to overlap for several nozzles in a direction perpendicular to a sheet conveyance direction, and selects whether to use nozzles in such overlapping areas depending on the degree of thermal expansion of the recording head.

As described above, an image forming apparatus employing a liquid discharge system typically discharges liquid droplets from a recording head to form an image on a sheet. When such liquid droplets adhere to the sheet the sheet may swell, thereby resulting in cockling, that is, a phenomenon in which the sheet is deformed into a wavy shape, which further may cause landing position deviation as described above.

As a result, certain conventional image forming apparatuses include a guide member, which may be called a platen, having ribs disposed opposite a recording head to support the sheet from below. Such guide member may be used to keep the sheet substantially flat during conveyance of the sheet.

Alternatively, one conventional inkjet recording apparatus includes a platen that deforms a sheet into a wavy shape along a direction perpendicular to a sheet conveyance direction. The platen also deforms the sheet using irregularities formed by a plurality of ribs arranged parallel to the sheet conveyance direction. Such conventional inkjet recording apparatuses also include projections that guide the sheet downward to recesses formed between the ribs of the platen, and prevent the sheet from floating toward a recording head side due to swelling.

Alternatively, in one conventional technique, a platen has a first rib extending in a sub-scanning direction and a second rib extending in the sub-scanning direction on a face opposite a recording head. The first rib is formed higher than the second rib in a direction toward the recording head, and is provided so as not to project out to a recording head side across a hypothetical line that passes through a nip between conveyance rollers.

In another conventional technique, the distance between a sheet and a liquid discharge face of a recording head is kept substantially constant by tops of ribs supporting the sheet from below in an area outside of a landing area of liquid droplets. In such a landing area of liquid droplets, the tops of ribs have a height such as not to contact the sheet from below. Alternatively, the platen is formed so as not to have such ribs in the landing area of liquid droplets.

However, in conventional image forming apparatuses with a line-type recording head in which a plurality of head units are arranged in one or more rows, liquid droplets discharged from respective end nozzles of adjacent head units may not land at a constant pitch in a border area between such adjacent head units. Consequently, a deviation in landing position and/or color may occur in such border area.

Further, if cockling occurs on a printed sheet, the distance between the sheet and one head unit provided on an upstream side in a sheet conveyance direction may differ from the distance between the sheet and another head unit on a downstream side in the sheet conveyance direction. Consequently, even when liquid droplets are discharged from adjacent head units with a normal timing, i.e., a timing suitable for a flat state of sheet, landing position deviation may occur in a border area between such liquid droplets, thereby degrading image quality.

For example, as illustrated in FIG. 1, assume that a head base 501 is provided with a head unit 502A and a head unit 502B on upstream and downstream sides, respectively, in a sheet conveyance direction Y. In such case, a liquid droplet "A" indicated by a white circle and a liquid droplet "B" indicated by a black circle are discharged from respective nozzles of the head unit 502A and the head unit 502B.

At this time, when a sheet 503 is conveyed at a normal flat state indicated by a dot-and-dash line 504 without being subjected to cockling in the sheet conveyance direction Y, liquid droplets are adjusted so that a landing position DA of the liquid droplet A and a landing position DB of the liquid droplet B may be precisely aligned adjacent to each other in a direction substantially perpendicular to the sheet conveyance direction Y as indicated by dashed circles in FIG. 2.

However, if the sheet 503 is deformed into a wave shape due to cockling as illustrated in FIG. 1, the liquid droplet A discharged from one nozzle of the head unit 502A may land on a lower portion of the sheet 503. At this time, the distance between the head unit 502A and the lower portion of the sheet 503 is longer than a normal distance therebetween. As a result, even when the liquid droplet A is discharged with a normal timing, the liquid droplet A lands on the sheet 503 with a later timing than when the sheet 503 is flat. Consequently, the landing position DA1 of the liquid droplet A deviates from the normal landing position DA in a direction opposite the sheet conveyance direction Y.

Meanwhile, the liquid droplet B discharged from one nozzle of the head unit 502B may land on a higher portion of the sheet 503 generated by such wavy deformation. At this time, the distance between the head unit 502B and the convex portion of the sheet 503 is shorter than a normal distance therebetween. As a result, when the liquid droplet B is discharged with a normal timing, the liquid droplet B lands on the sheet 503 with an earlier timing than when the sheet 503 is flat. Consequently, the landing position DB1 of the liquid droplet B deviates from the landing position DB1 of the liquid droplet B in the same direction as the sheet conveyance direction Y.

Further, even a slight amount of landing position deviation in a sheet conveyance direction occurring between liquid droplets discharged from adjacent different head units may have a noticeable effect on the resultant image, thereby degrading the image quality.

When swelling occurs in a sheet due to cockling, the sheet is deformed so as to extend in a direction perpendicular to a sheet conveyance direction, which may result in a landing position deviation as described above. In such case, the amount of deviation may become significantly large in areas where the plurality of head units overlap. Consequently, white or black streaks may be easily generated in such areas, thereby degrading image quality.

BRIEF SUMMARY

In an aspect of this disclosure, there is provided an image forming apparatus capable of forming a quality image while suppressing a landing position deviation between liquid droplets in a sheet conveyance direction.

In another aspect of this disclosure, an image forming apparatus includes a recording head, a conveyance member, and a guide member. The recording head includes a plurality of head units to discharge liquid droplets onto a recording medium, each of the plurality of head units having a plurality of nozzles through which liquid droplets are discharged. The conveyance member conveys the recording medium in a direction substantially perpendicular to a direction in which the plurality of head units are arranged. The guide member includes a plurality of ribs of at least two, first and second, types having different heights, and is disposed opposite the recording head so as to guide the recording medium. The first type of ribs, having a height greater than a height of the second type of ribs, are disposed opposite areas where the plurality of head units overlap in the arranged direction thereof.

BRIEF DESCRIPTION OF THE DRAWINGS

The aforementioned and other aspects, features and advantages would be better understood by reference to the following detailed description when considered in connection with the accompanying drawings, wherein.

DETAILED DESCRIPTION OF THE INVENTION

Figure 1:
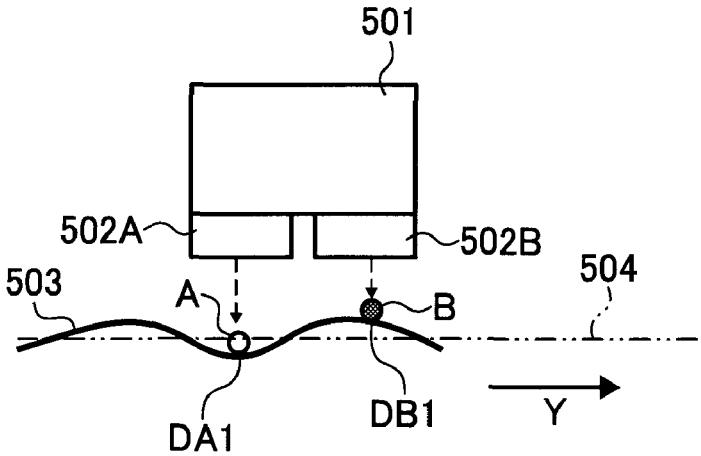
FIG. 1 CONVENTIONAL ART
FIG. 1 is an illustration of a landing position deviation in a sheet conveyance direction that may be caused by cockling in a conventional image forming apparatus.
Figure 2:
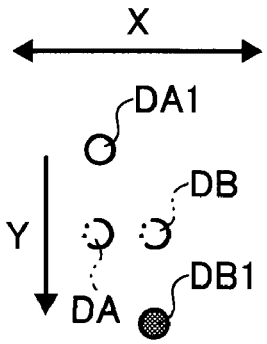
FIG. 2 CONVENTIONAL ART
FIG. 2 is a plan view of the landing position deviation of FIG. 1.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. For the sake of simplicity, the same reference numerals are used in the drawings and the descriptions for the same materials and constituent parts having the same functions, and redundant descriptions thereof are omitted.

Exemplary embodiments of the present disclosure are now described below with reference to the accompanying drawings. It should be noted that, in a later-described comparative example, exemplary embodiment, and alternative example, the same reference numerals are used for the same constituent elements such as parts and materials having the same functions, and redundant descriptions thereof are omitted.

Figure 3:
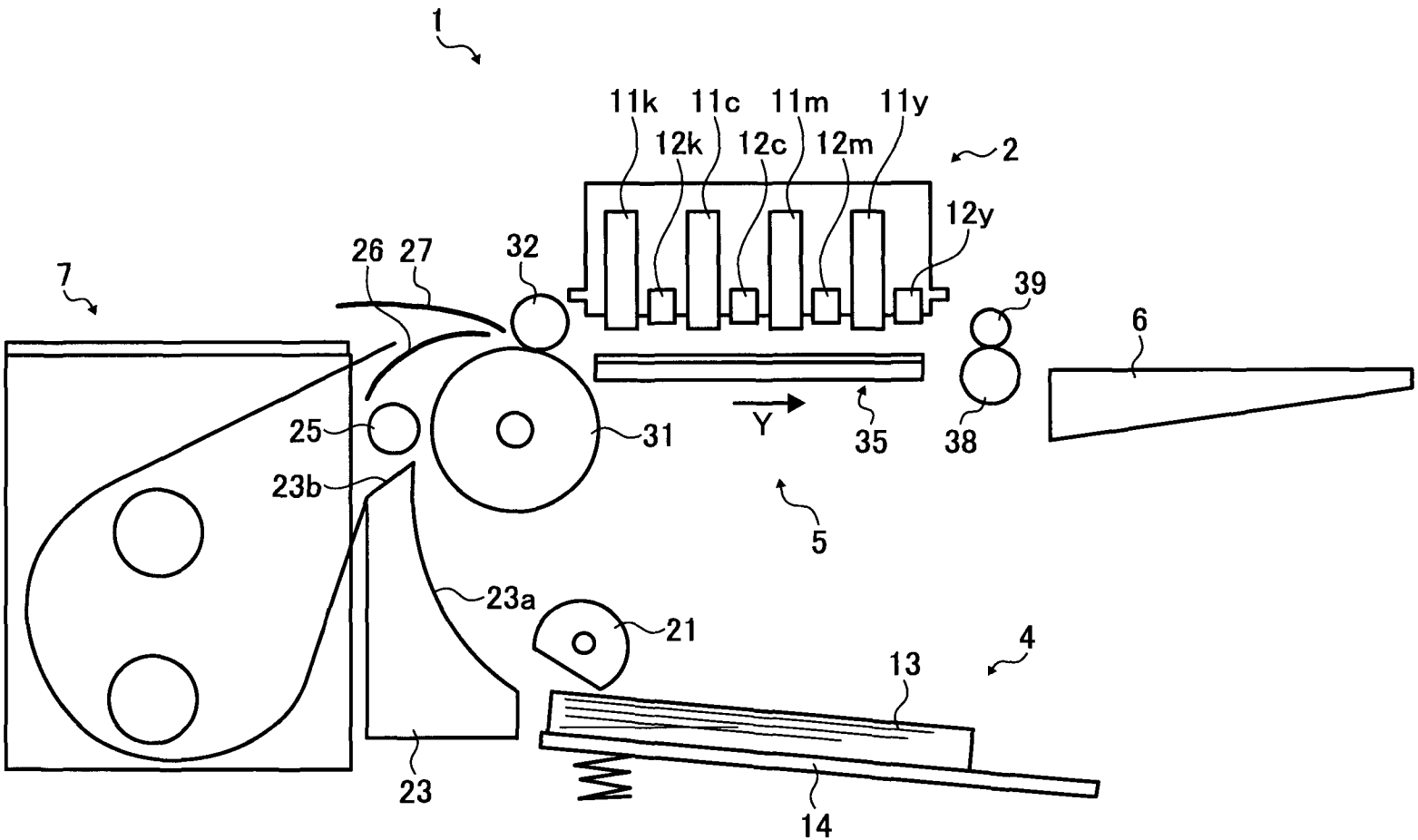
FIG. 3 is a schematic view illustrating a general configuration of an image forming apparatus according to exemplary embodiments of the present invention.

FIG. 3 is a schematic view illustrating a configuration of an image forming apparatus 1 according to an exemplary embodiment.

As illustrated in FIG. 3, the image forming apparatus 1 may include an image forming section 2, a sheet feeding section 4, and a conveyance section 5. In the sheet feeding section 4, a sheet tray 14 accommodates a stack of sheets 13. A sheet 13 is fed from the sheet tray 14 to the conveyance section 5. While the sheet 13 is being conveyed by the conveyance section 5, the image forming section 2 forms a desired image on the sheet 13. The sheet 13 having the image thereon is ejected to a catch tray 6 disposed at one side of the image forming apparatus 1.

It should be noted that the term "sheet" used herein refers to a medium, a recording medium, a recorded medium, a sheet material, a transfer material, a recording sheet, a paper sheet, or the like. The sheet may also be made of material such as paper, string, fiber, cloth, leather, metal, plastic, glass, timber, and ceramic. Further, the term "image formation" used herein refers to providing, recording, printing, or imaging an image, a letter, a figure, a pattern, or the like onto the sheet. Further, the term "liquid" used herein is not limited to a recording agent or ink, and may include anything discharged in the form of a fluid. Hereinafter, such liquid may be simply referred to as "ink". Furthermore, the term "liquid discharge device" refers to a device for discharging liquid from a liquid discharge head to form an image, a letter, a figure, a pattern, or the like.

As illustrated in FIG. 3, a duplex unit 7 may be detachably mounted in the image forming apparatus 1. In duplex printing, when an image is formed on a first face of a sheet 13, the sheet 13 is conveyed in a direction opposite to the direction indicated by an arrow Y in FIG. 3 and is sent into the duplex unit 7. The duplex unit 7 turns the sheet 13 over so that an image can be formed on a second face of the sheet 13, and then the sheet 13 is sent back to the conveyance section 5. When an image is formed on the second face of the sheet 13, the sheet 13 is ejected to the catch tray 6.

As illustrated in FIG. 3, the image forming section 2 may include four line-type recording heads 11*k*, 11*c*, 11*m*, and 11*y* capable of discharging liquid droplets of black, cyan, magenta, and yellow colors, respectively (hereinafter, collectively referred to as "recording head 11" if needed). Each recording head 11 has a nozzle formation face on which a plurality of nozzles are formed to discharge liquid droplets therethrough. Each recording head 11 is attached to a head holder 15 so that each nozzle formation face thereof is directed downward.

The image forming apparatus 1 may also include maintenance-and-recovery units 12*k*, 12*c*, 12*m*, and 12*y* (hereinafter, collectively referred to as "maintenance-and-recovery unit 12" if needed) to maintain and recover the performance of the recording heads 11*k*, 11*c*, 11*m*, and 11*y*, respectively. When performing a maintenance operation, for example, purging or wiping, the image forming apparatus 1 moves the recording heads 11 and the maintenance-and-recovery units 12 so that, for example, capping members of the maintenance-and-recovery members 12 are positioned opposite the corresponding nozzle formation faces of the recording heads 11.

Figure 4:
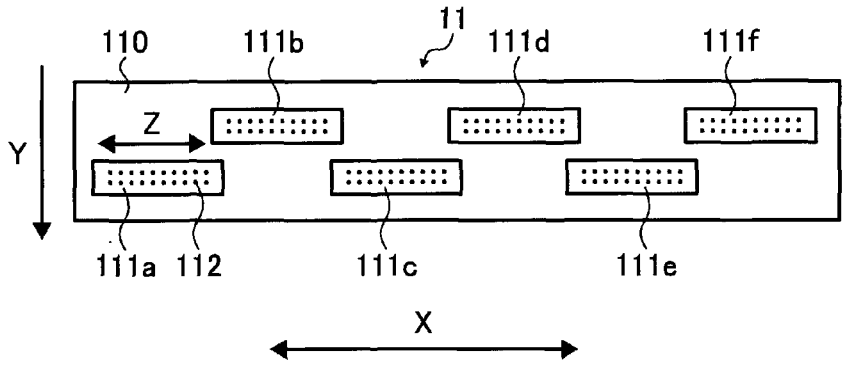
FIG. 4 is a plan view illustrating a configuration of a recording head.

As illustrated in FIG. 4, in each recording head 11, a plurality of head units 111*a* to 111*f* serving as liquid discharge heads may be arranged on a base 110 in a direction X perpendicular to a sheet conveyance direction Y. The plurality of head units 111*a* to 111*f* may also be staggered so that a nozzle array direction Z of a plurality of nozzles 112 is parallel to the head-unit array direction X of the head units 111*a* to 111*f*. Hereinafter, this type of recording head is referred to as "staggered-array recording head 11".

Figure 5:
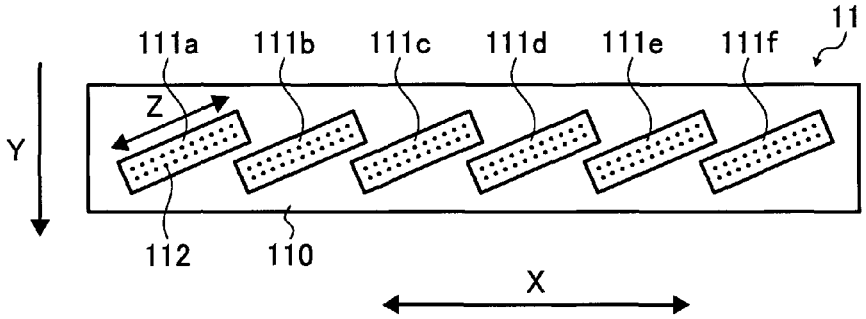
FIG. 5 is a plan view illustrating a configuration of a recording head.

Alternatively, as illustrated in FIG. 5, in each recording head 11, a plurality of head units 111*a* to 111*f* may be arranged on a base 110 in such a manner that a nozzle array direction Z of a plurality of nozzles 112 is inclined at a certain angle relative to a sheet conveyance direction Y. Hereinafter, this type of recording head is referred to as "inclined-array recording head 11".

Figure 6:
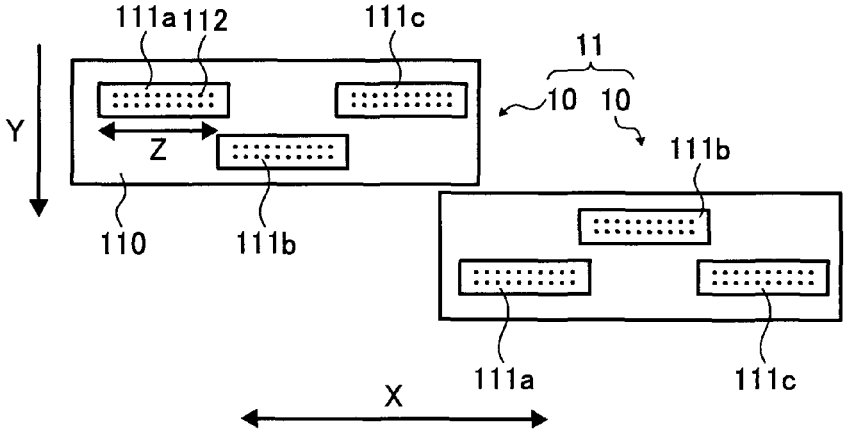
FIG. 6 is a plan view illustrating a configuration of a recording head.

Alternatively, as illustrated in FIG. 6, each recording head 11 may include a plurality of head segments 10 that are arranged parallel to and slightly offset from each other in a lateral direction. In each head segment 10, a plurality of head units 111*a* to 111*c* are arranged on a base 110 in a direction X substantially perpendicular to a sheet conveyance direction Y in a staggered manner so that a nozzle array direction Z of a plurality of nozzles 112 is parallel to the head-unit array direction X of the head units 111*a* to 111*c*.

As described above, in the image forming apparatus 1 of FIG. 3, the recording heads 11 are arranged in the order black, cyan, magenta, and yellow from the upstream side in the sheet conveyance direction Y. However, it should be noted that the number and order of colors of recording heads 11 are not limited to those described above, and may be any suitable number and order. Further, each recording head 11 may be integrally formed with a cartridge supplying a recording liquid of a corresponding color.

Each head unit of the recording head 11 may employ a piezoelectric actuator that deforms a diaphragm with an electromechanical transducer, for example, a piezoelectric element serving as a pressure generator to generate a pressure for discharging liquid droplets. Alternatively, each head unit may employ a thermal actuator to cause film boiling in a recording liquid and thus generate bubbles in the liquid, or an electrostatic actuator to generate an electrostatic force between a diaphragm and an electrode and thus deform the diaphragm.

Referring back to FIG. 3, a sheet 13 stacked in the sheet feeding tray 14 of the sheet feeding section 4 is separated and fed sheet by sheet by a feed roller 21 and a separation pad. The sheet 13 is fed along a guide face 23*a* of a feeding guide 23 and is forwarded to a nip between a registration roller 25 and a conveyance roller 31 via a first guide 26. The sheet 13 is forwarded with an appropriate timing to an image forming region of the recording heads 11.

As illustrated in FIG. 3, the feeding guide 23 may have a guide face 23*b* to guide a sheet 13 forwarded from the duplex unit 7. Further, the image forming apparatus 1 may include a second guide 27 to guide the sheet 13, which is forwarded from the conveyance section 5 in duplex printing, into the duplex unit 7.

As illustrated in FIG. 3, the conveyance section 5 may include the conveyance roller 31 serving as a conveyance member, a press roller 32 serving as a pressing member, a platen guide 35, an ejection roller 38, and a spur 39. The press roller 32 presses the sheet 13 against the conveyance roller 31. The conveyance roller 31 rotates to convey the sheet 13 to the platen guide 35. The platen guide 35, serving as a guide member, is disposed at a position opposite the image forming section 2 in order to keep the surface of the sheet 13 substantially flat during conveyance of the sheet 13. The ejection roller 38 and the spur 39 work together to eject the sheet 13, on which an image has been formed, to the catch tray 6.

In the image forming apparatus 1 configured as described above, a sheet 13 is separated sheet by sheet by the sheet feeding section 4 and is fed to the nip between the registration roller 25 and the conveyance roller 31. While being pressed by the press roller 32 against the conveyance roller 31, the sheet 13 is forwarded by rotation of the conveyance roller 31 to the platen guide 35. The sheet 31 is guided by the platen guide 35 to image forming areas of the recording heads 11. While the sheet 13 is being passed through the image forming areas, the recording heads 11 discharge liquid droplets onto the sheet 13 to form a desired image thereon. The sheet 13 having the image thus formed is ejected by the ejection roller 38 to the catch tray 6.

Next, a first exemplary embodiment is described with reference to FIGS. 7 and 8.

Figure 7:
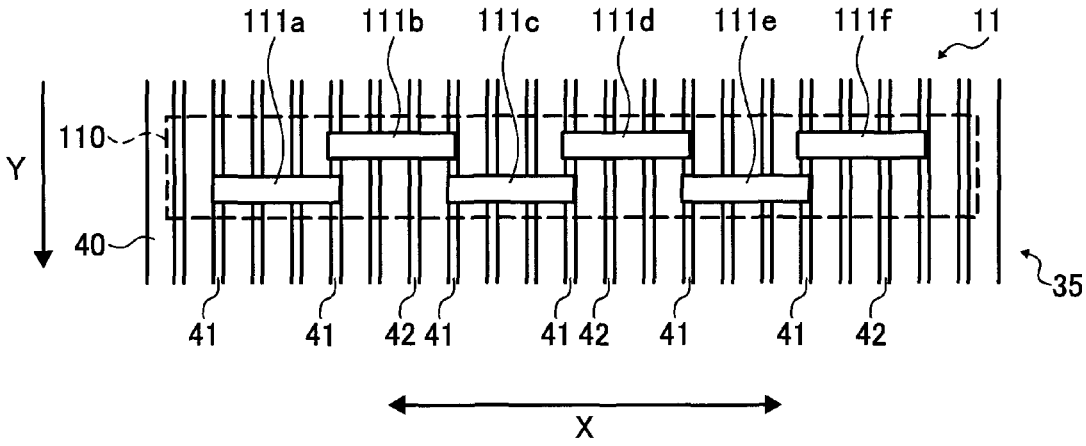
FIG. 7 is a plan view illustrating a recording head and a portion of a platen member according to a first exemplary embodiment.

FIG. 7 is a plan view of a recording head 11 and a portion of a platen guide 35. FIG. 8 is a side view of the recording head 11 and the platen guide 35 of FIG. 7 viewed from a sheet ejection side, which corresponds to a right side view of FIG. 3.

Figure 8:
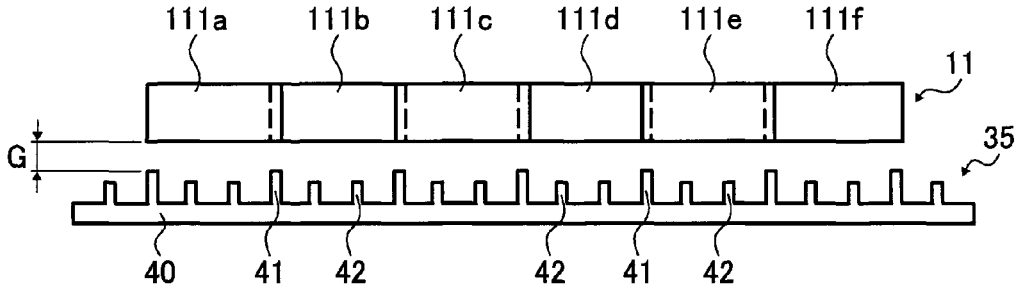
FIG. 8 is a schematic view of the recording head and the platen member of FIG. 7 viewed from a sheet ejection side.

In FIGS. 7 and 8, the platen guide 35, serving as a guide member, is disposed at a position opposite a staggered-array recording head 11 to guide the sheet 13. It should be noted that the position of the platen guide 35 is not limited to the above-described position, and may be any suitable position.

The platen guide 35 includes, for example, first and second ribs 41 and 42 that are different in height. It should be noted that the number of types of ribs may be three or more. The first ribs 41 are formed higher than the second ribs 42. As illustrated in FIG. 8, a given gap G is formed between the recording head 11 and each top face of the first ribs 41.

As illustrated in FIG. 8, the first ribs 41 are disposed at positions corresponding to areas in which adjacent ones of a plurality of head units 111 overlap in a head-unit array direction of the plurality of head units 111 when viewed from a sheet ejection side. In other words, the higher of the two different types of ribs is disposed at positions corresponding to such overlapping areas.

Figure 9:
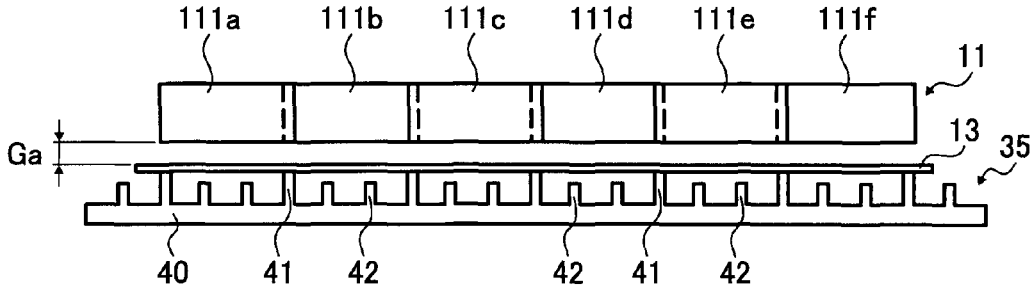
FIG. 9 is a schematic view illustrating a state in which a sheet is conveyed between the recording head and the platen member of FIG. 8 when cockling does not occur in the sheet.

For such a configuration, if cockling does not occur on the sheet 13, the sheet 13 is conveyed while being supported from below by the first ribs 41 as illustrated in FIG. 9. Thus, during conveyance of the sheet 13, a gap Ga between the recording head 11 and the sheet 13 can be kept substantially constant.

Figure 10:
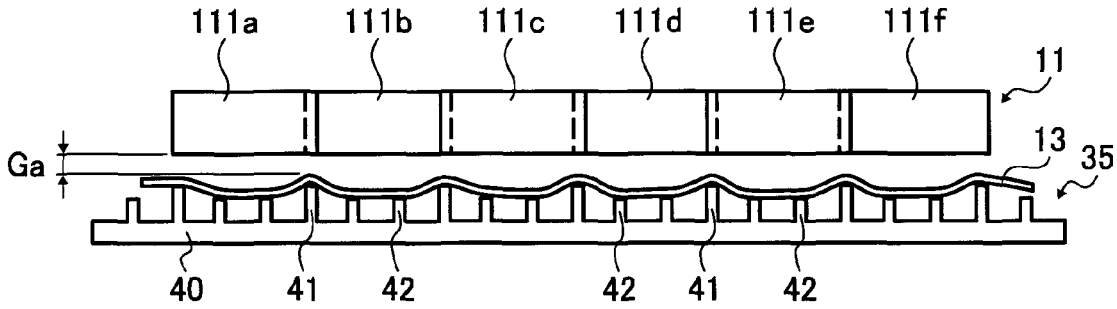
FIG. 10 is a schematic view illustrating a state in which a sheet is conveyed between the recording head and the platen member of FIG. 8 when cockling occurs in the sheet.

However, if cockling occurs on the sheet 13 as illustrated in FIG. 10, extended portions of the sheet 13 created by swelling may fall between the first ribs 41, and such extended portions are supported from below by the second ribs 42. As a result, the sheet 13 is deformed so as to wave in a direction substantially perpendicular to a conveyance direction of the sheet 13. Thus, even if cockling occurs on the sheet 13, the portions of the sheet 13 supported by the first ribs 41 can be prevented from floating toward the recording head 11 and shifting in the direction substantially perpendicular to the sheet conveyance direction.

Thus, in such areas in which adjacent head units 111 of the recording head 11 overlap, the sheet 13 can be prevented from floating and sinking due to swelling, thereby suppressing fluctuation in the gap Ga between the recording head 11 and the sheet. Accordingly, similar to when cockling does not occur on the sheet 13, a landing position deviation as described above in the sheet conveyance direction can be prevented, thus suppressing degradation of image quality.

Figure 25:
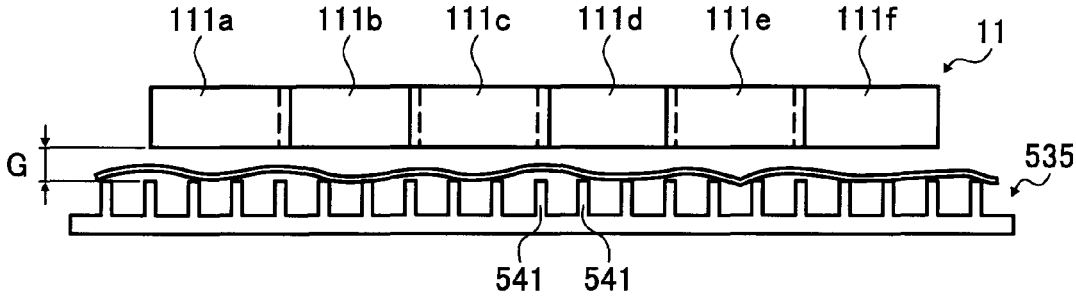
FIG. 25 is a schematic view illustrating a recording head and a platen member of first comparative example.

For example, in a first comparative example illustrated in FIG. 25, a recording head 11 includes a plurality of head units 111 that are staggered, and a platen guide 535 includes a plurality of ribs 541 having a substantially identical height. If cockling occurs on a sheet 13 while the sheet 13 is being guided by the platen guide 535, some portions of the sheet 13 may float toward the recording head 11 due to swelling. Further, the sheet 13 may be randomly extended or spread in a direction perpendicular to a conveyance direction of the sheet 13. Consequently, in border areas in which liquid droplets discharged from adjacent head units 111 are joined together, landing position deviation in a sheet conveyance direction and/or white or black streaks as described above may occur, thereby degrading image quality.

Figure 26:
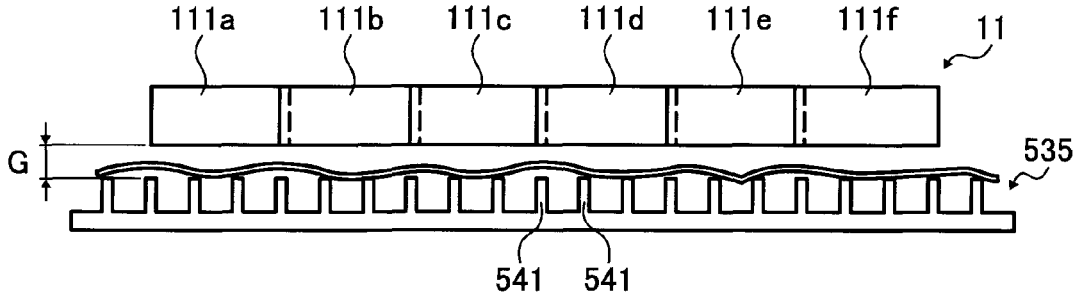
FIG. 26 is a schematic view illustrating a recording head and a platen member of second comparative example.

Alternatively, in a second comparative example as illustrated in FIG. 26, a recording head 11 includes a plurality of head units 111 that are arranged in a row so that each head unit is inclined at a certain angle to a sheet conveyance direction. A platen guide 535 includes a plurality of ribs 541 having a substantially identical height. Similar to the first comparative example, in border areas between images formed by adjacent head units 111, landing position deviation in the sheet conveyance direction and white or black streaks may occur, thereby degrading image quality.

By contrast, when a sheet 13 is guided by the platen guide 35 according to the first exemplary embodiment, the sheet 13 can be prevented from floating toward the recording head 11 in border areas in which liquid droplets discharged from adjacent head units 111 are joined together. Thus, a landing position deviation in the sheet conveyance direction and/or white or black streaks can be suppressed, thus increasing image quality.

As described above, in the image forming apparatus 1, the guide member, configured as the platen guide 35 in FIGS. 7 to 10, is disposed at a position opposite the recording head to guide a sheet. The guide member includes a plurality of types of ribs that are different in height and are formed along a sheet conveyance direction Y. The relatively higher ribs of the plurality of types of ribs are disposed at positions corresponding to areas in which adjacent head units overlap in an array direction X of the plurality of head units when viewed from a sheet ejection side. Thus, the sheet can be prevented from floating and sinking due to swelling in such overlapping areas. As a result, a landing position deviation of liquid droplets in the sub-scanning direction can be prevented, thus improving image quality.

Next, a second exemplary embodiment is described with reference to FIGS. 11 and 12.

Figure 11:
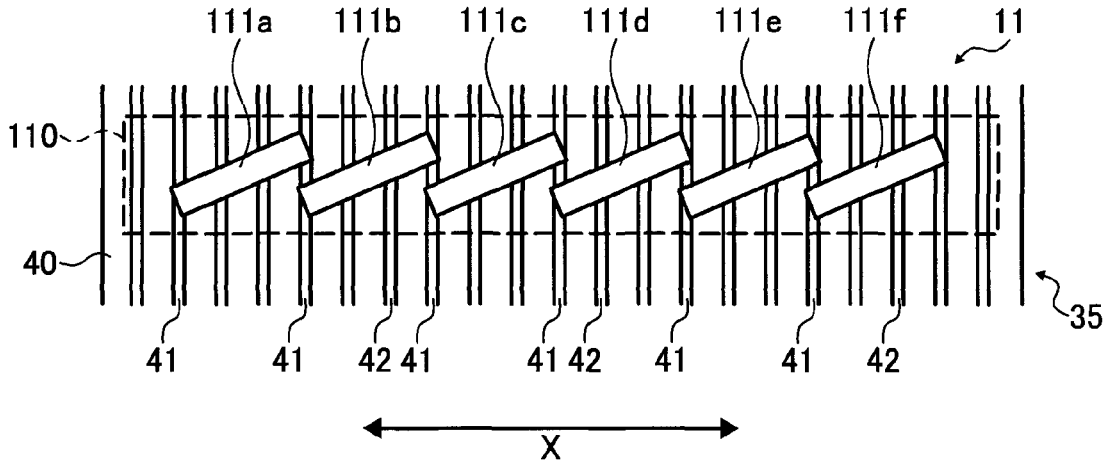
FIG. 11 is a plan view illustrating a recording head and a portion of a platen member according to a second exemplary embodiment.
Figure 12:
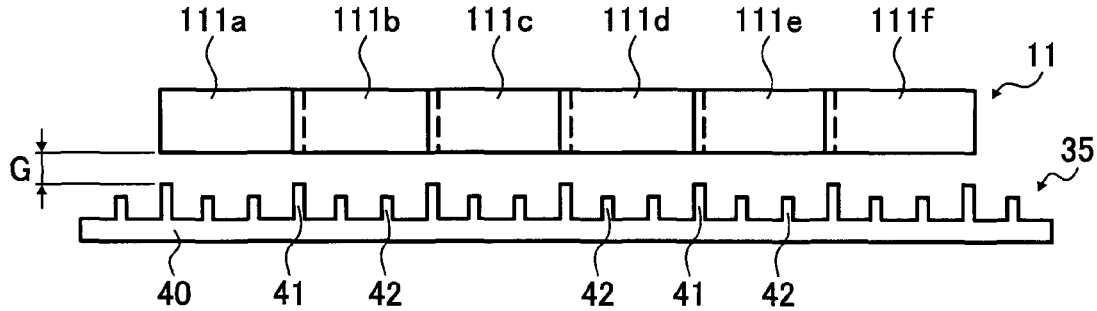
FIG. 12 is a schematic view illustrating the recording head and the platen member of FIG. 11 viewed from a sheet ejection side.

FIG. 11 is a partial plan view illustrating a recording head 11 and a portion of a platen guide 35, and FIG. 12 is a side view illustrating the recording head 11 and the platen guide 35 of FIG. 11 viewed from a sheet ejection side, which corresponds to a right side view of FIG. 3.

In FIG. 11, the platen guide 35, serving as a guide member that guides a sheet 13, is disposed at a position opposite an inclined-array recording head 11. It should be noted that the position of the guide member is not limited to the opposite position of the recording head 11 and may be any suitable location.

The platen guide 35 includes a plurality of types of ribs that are different in height and are formed along a sheet conveyance direction. In FIG. 12, the platen guide 35 includes two types of ribs, i.e., first ribs 41 and second ribs 42. The first ribs 41 are formed higher than the second ribs 42. It should be noted that the number of types of ribs is not limited to two and may be three or more.

The first ribs 41 are disposed at positions corresponding to areas in which adjacent head units 111 overlap in a head-unit array direction X when viewed from the sheet ejection side. In other words, the higher of the two types of ribs, that is, the first ribs 41, are disposed at positions corresponding to the areas of overlap between each head unit 111 of the plurality of head units 111.

Figure 13:
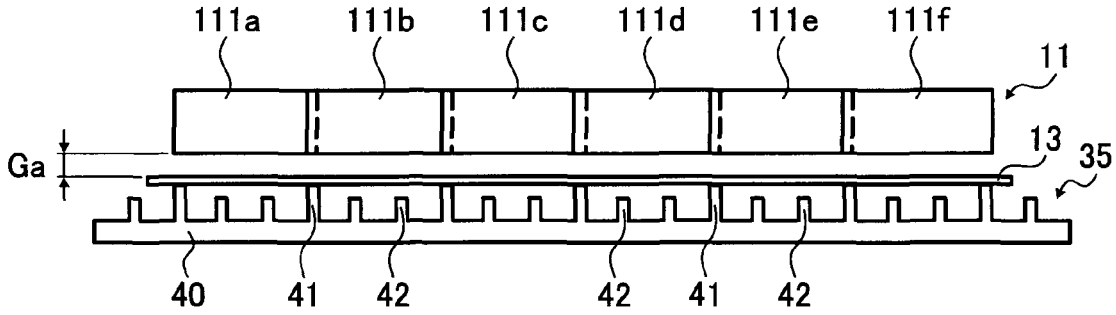
FIG. 13 is a schematic view illustrating a state in which a sheet is conveyed between the recording head and the platen member of FIG. 12 when cockling does not occur in the sheet.

In such a configuration, when cockling does not occur on the sheet 13, the sheet 12 is conveyed while being supported from below by the first ribs 41 as illustrated in FIG. 13.

Figure 14:
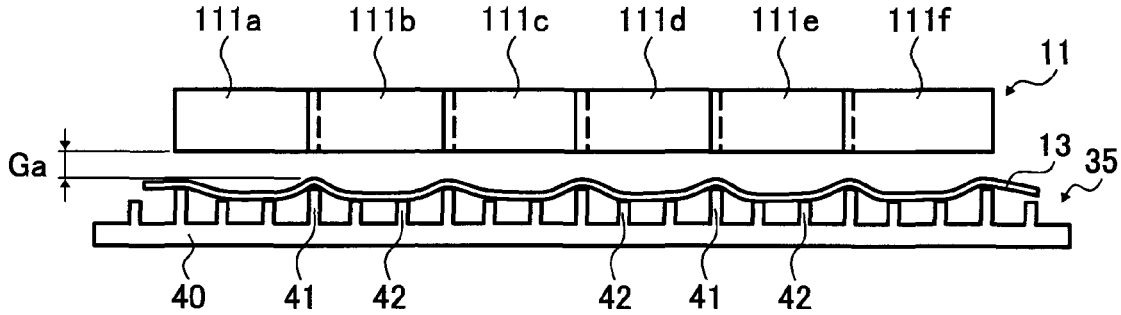
FIG. 14 is a schematic view illustrating a state in which a sheet is conveyed between the recording head and the platen member of FIG. 12 when cockling occurs in the sheet.

However, when cockling occurs on the sheet 13 as illustrated in FIG. 14, extended portions of the sheet 13 created by swelling may drop between the first ribs 41, and such extended portions are supported from below by the second ribs 42. As a result, the sheet 12 is guided so as to wave in a direction substantially perpendicular to the sheet conveyance direction. Thus, even if cockling occurs on the sheet 13, the portions of the sheet 13 supported by the first ribs 41 can be prevented from floating toward the recording head 11 or shifting in the direction perpendicular to the sheet conveyance direction.

Further, in such areas of overlap between the head units 111, the sheet 13 can be prevented from floating and sinking due to swelling, thus significantly reducing fluctuation in the gap Ga between the recording head 11 and the sheet 13. Accordingly, similar to when cockling does not occur in the sheet 13, landing position deviation can be prevented from occurring in the sheet conveyance direction.

As described above, regardless of the configuration of the recording head, the sheet 13 can be prevented from floating and sinking due to swelling in areas in which adjacent head units overlap in a head-unit array direction thereof when viewed from the sheet ejection side. Thus, landing position deviation of liquid droplets in the sheet conveyance direction can be prevented, thus improving image quality.

Next, a third exemplary embodiment is described with reference to FIGS. 15 and 16.

Figure 15:
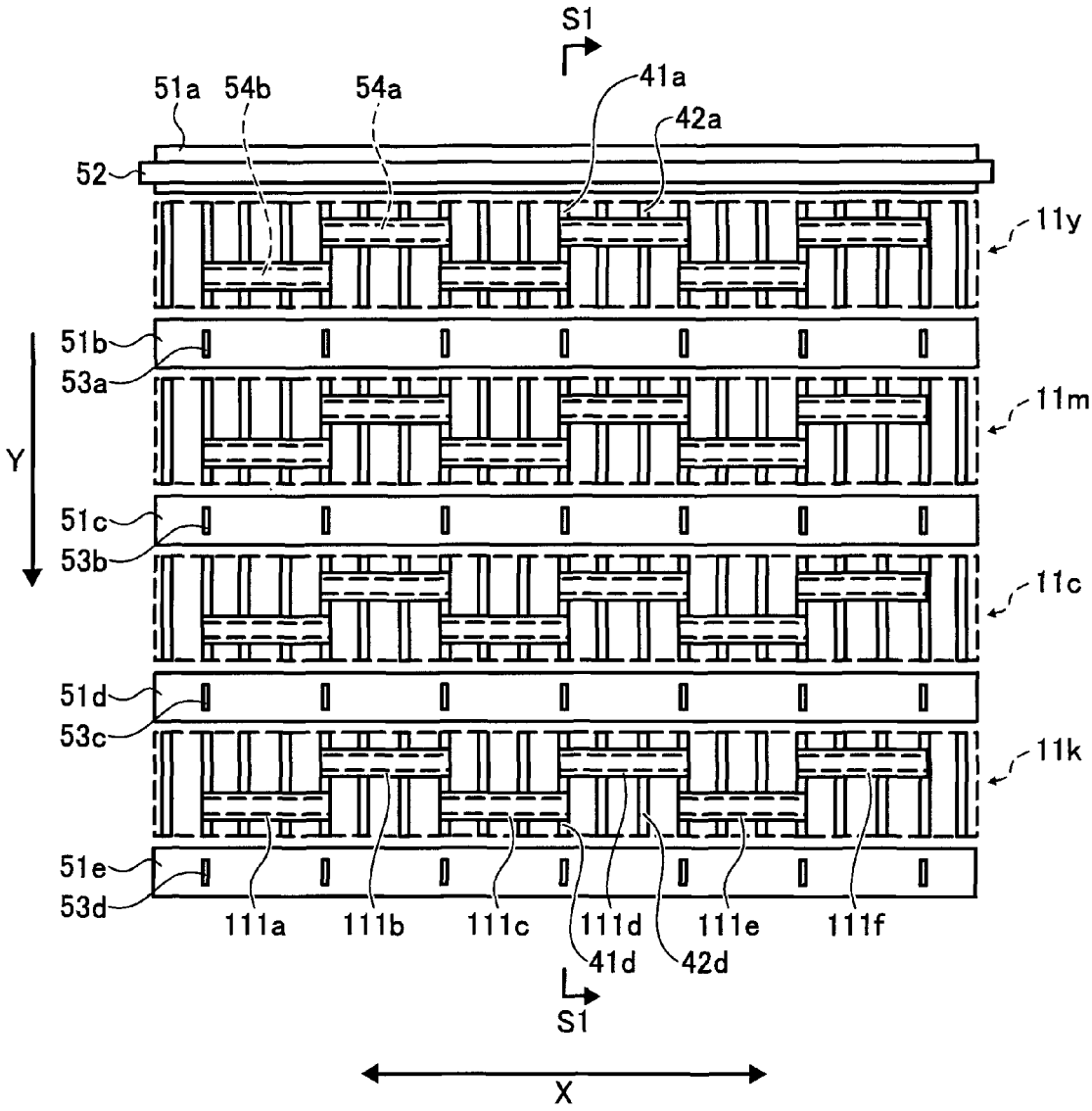
FIG. 15 is a plan view illustrating a third exemplary embodiment.
Figure 16:
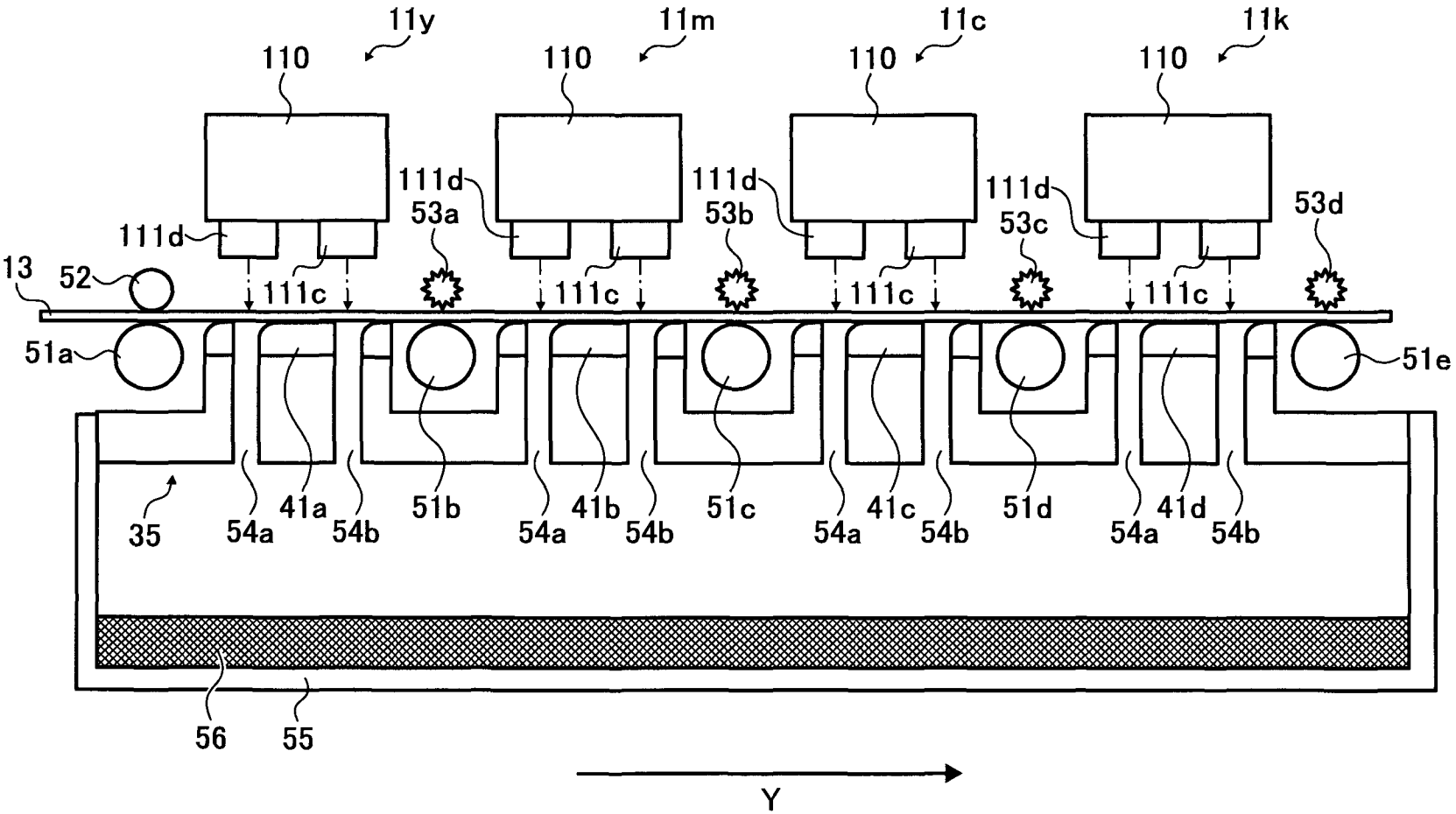
FIG. 16 is a sectional view taken along line S1-S1 of FIG. 15.

FIG. 15 is a plan view illustrating the third exemplary embodiment, and FIG. 16 is a sectional view taken along S1-S1 line of FIG. 15. In FIG. 16 and following drawings, a portion of sectional hatching is omitted for the sake of simplicity.

As illustrated in FIG. 15, feed rollers 51*a*, 51*b*, 51*c*, 51*d*, and 51*e* are disposed opposite a pressure roller 52 and spurs 53*a*, 53*b*, 53*c*, and 53*d* on upstream and downstream sides of staggered-array recording heads 11*y*, 11*m*, 11*c*, and 11*k* in a sheet conveyance direction Y. The pressure roller 52 and the spurs 53*a*, 53*b*, 53*c*, and 53*d* serve as pressing members to press a sheet against the feed rollers 51*a*, 51*b*, 51*c*, 51*d*, and 51*e*, respectively.

The spurs 53*a*, 53*b*, 53*c*, and 53*d* are disposed at positions corresponding to areas in which adjacent ones of a plurality of head units 111 overlap in a head-unit array direction X thereof. In FIG. 15, the feed roller 51*a* on the extreme upstream side in the sheet conveyance direction Y serves as a conveyance member instead of the conveyance roller 31 of FIG. 3, and the pressure roller 52 serves as a pressing member instead of the press roller 32 of FIG. 3.

Further, in the platen guide 35, first ribs 41*a*, 41*b*, 41*c*, and 41*d* and second ribs 42*a*, 42*b*, 42*c*, and 42*d* are formed at positions opposite the recording heads 11. As illustrated in FIGS. 15 and 16, the first ribs 41*a* to 41*d* and the second ribs 42*a* to 42*d* are not formed directly below areas in which a plurality of nozzles 112 of each recording head 11 are formed. Instead, slits 54*a* and 54*b* are formed directly below such nozzle formation areas. Below the platen guide 35 is disposed a waste liquid receiver 55 to receive liquid droplets drained through the slits 54*a* and 54*b*. As illustrated in FIG. 16, the waste liquid receiver 55 may contain an absorbing member 56.

The above-described configuration may allow each recording head 11 to perform a maintenance discharge operation to discharge liquid droplets for maintenance while a sheet 13 does not exist between the recording head 11 and the platen guide 35. Thus, such configuration can provide a high-speed printing operation without reducing the printing speed of the recording heads 11.

Next, a fourth exemplary embodiment is described with reference to FIG. 17.

Figure 17:
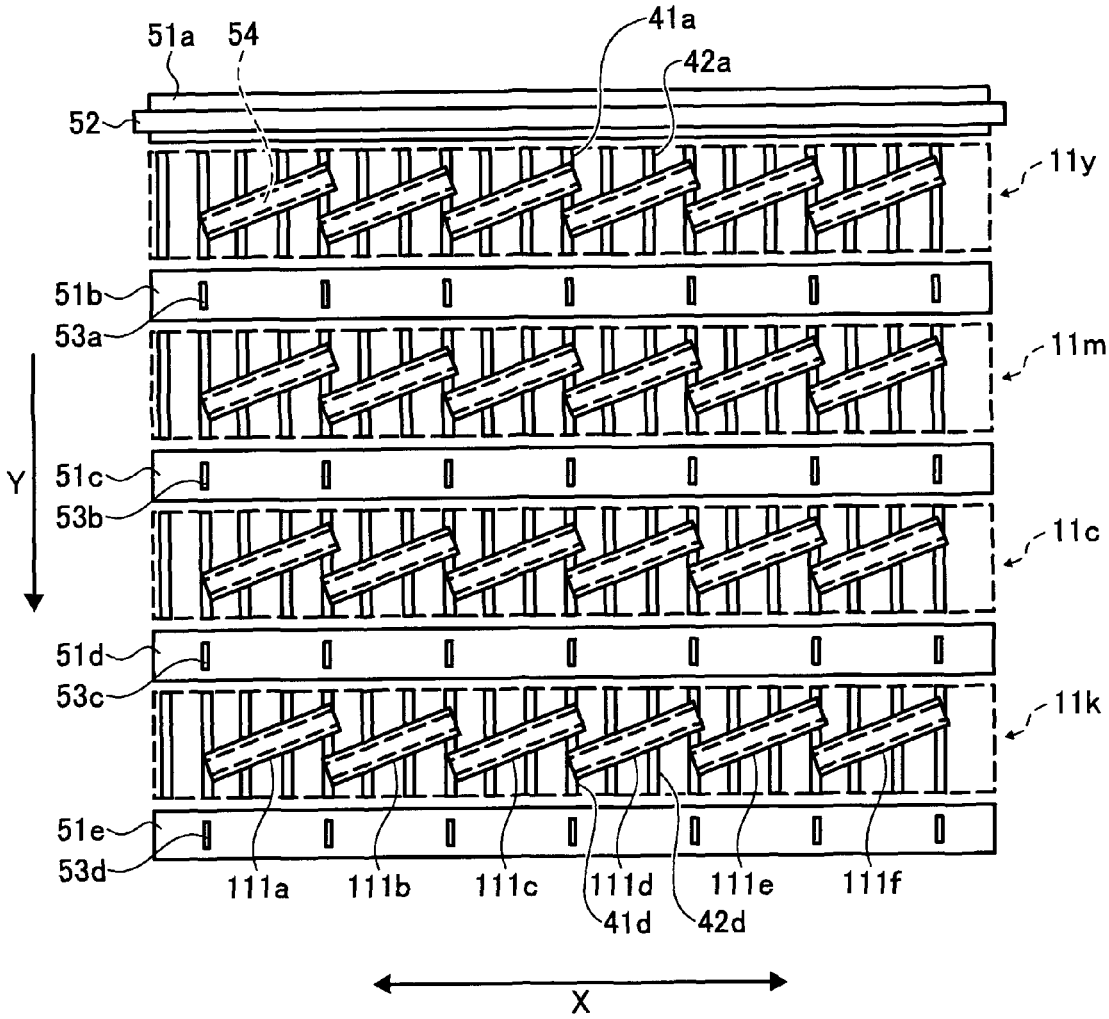
FIG. 17 is a plan view illustrating a fourth exemplary embodiment.

FIG. 17 is a plan view illustrating the fourth exemplary embodiment. The fourth exemplary embodiment has a configuration substantially identical to the third exemplary embodiment, except that, in FIG. 17, the staggered-array recording heads 11 of FIG. 15 are replaced with inclined-array recording heads 11. In this configuration as well, a maintenance discharge operation described above can be performed when a sheet 13 does not exist between a platen guide 35 and the recording heads 11, thus providing a high-speed printing operation without significantly reducing the printing speed of the recording heads 11.

Next, a fifth exemplary embodiment is described with reference to FIGS. 18 and 19.

Figure 18:
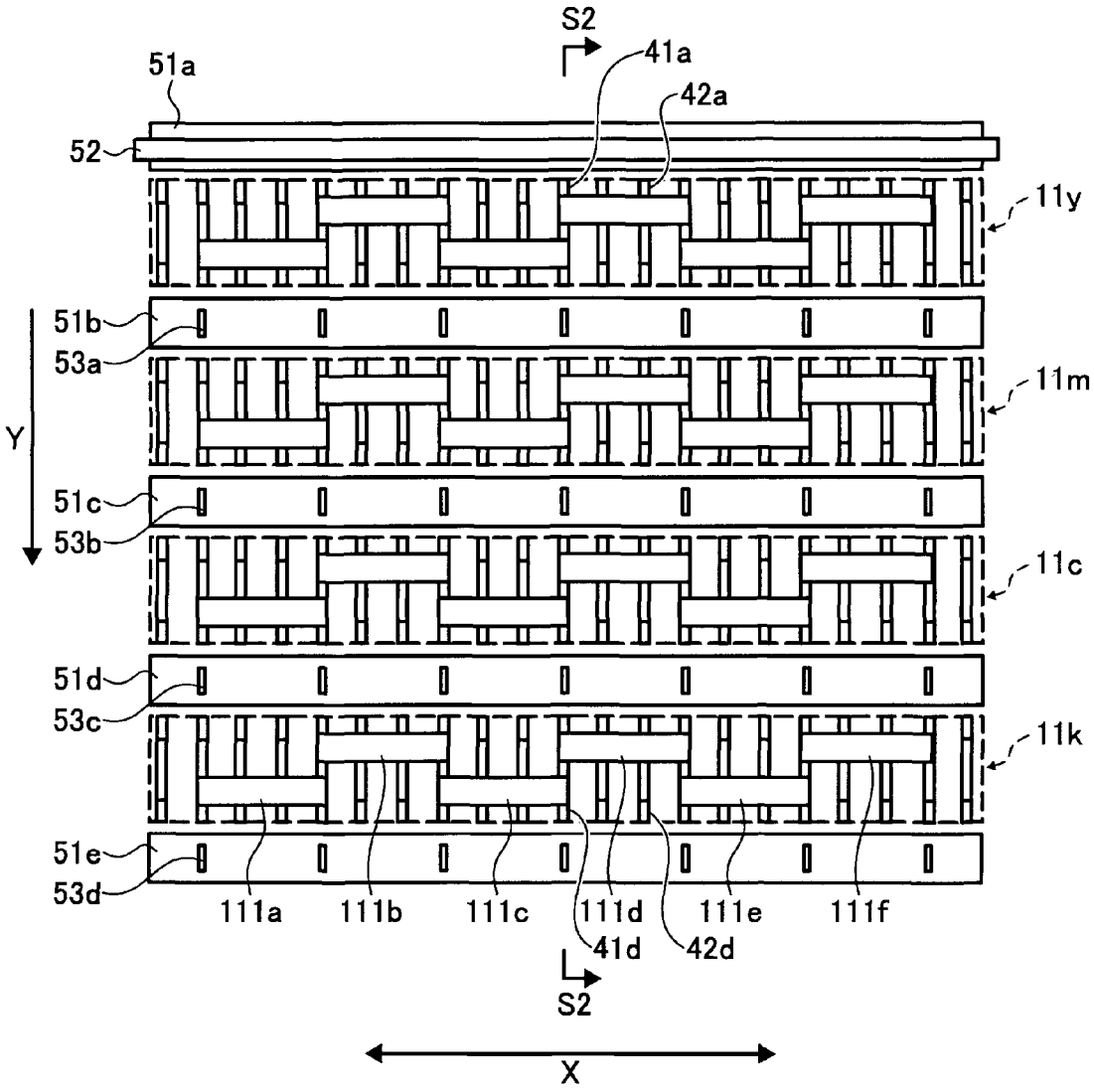
FIG. 18 is a plan view illustrating a fifth exemplary embodiment.
Figure 19:
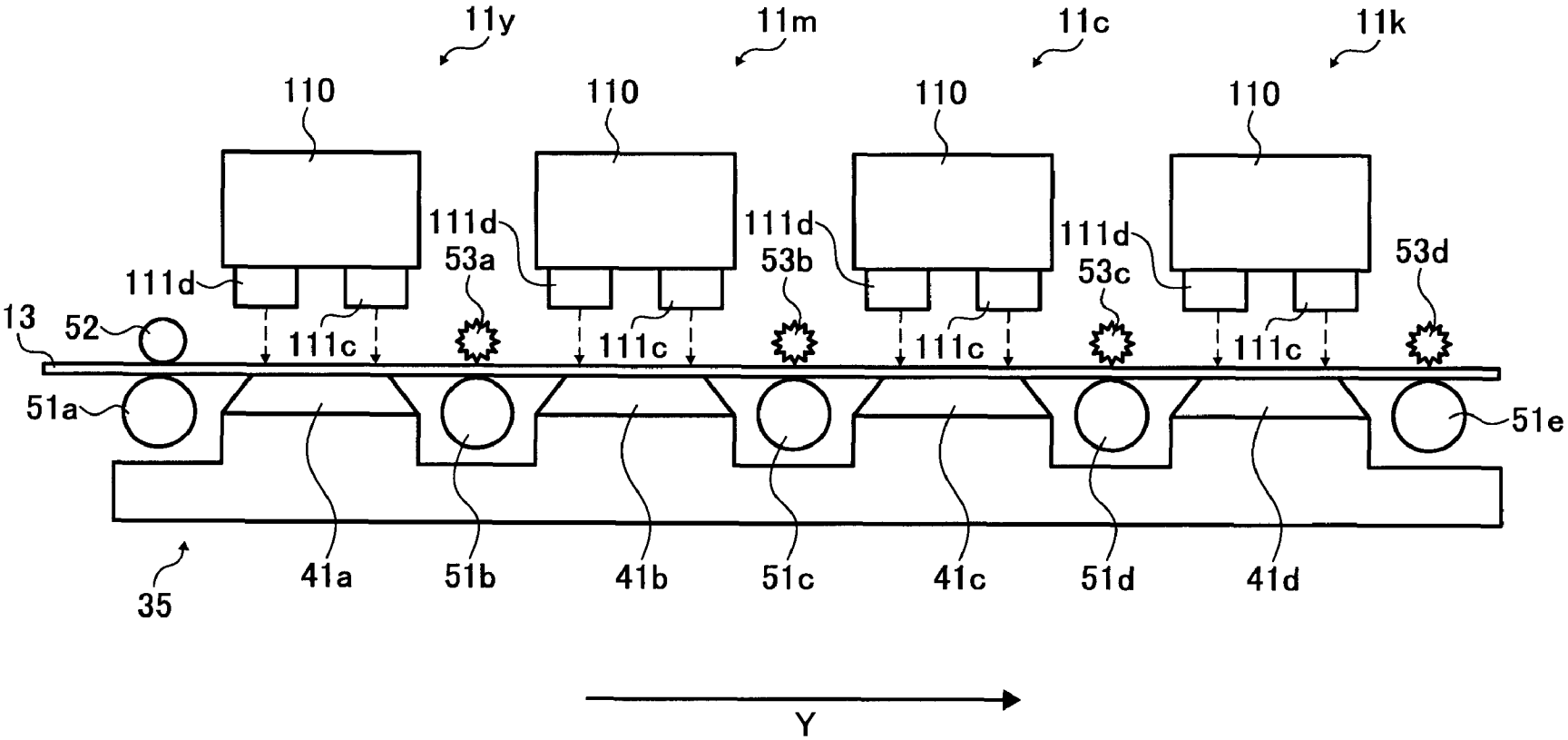
FIG. 19 is a sectional view taken along S2-S2 line of FIG. 18.

FIG. 18 is a plan view illustrating the fifth exemplary embodiment and FIG. 19 is a sectional view taken along S2-S2 line of FIG. 18.

In FIG. 18, feed rollers 51*a*, 51*b*, 51*c*, 51*d*, and 51*e* are disposed opposite a pressure roller 52 and spurs 53*a*, 53*b*, 53*c*, and 53*d* on upstream and downstream sides of staggered-array recording heads 11*y*, 11*m*, 11*c*, and 11*k* in a sheet conveyance direction Y.

The spurs 53*a*, 53*b*, 53*c*, and 53*d* are disposed at positions corresponding to areas in which adjacent ones of a plurality of head units 111*a* to 111d*f* overlap in a head-unit array direction X thereof. As illustrated in FIGS. 18 and 19, in the platen guide 35, first ribs 41*a* to 41*d*, and second ribs 42*a* to 42*d* are provided only directly below the recording heads 11.

Thus, in areas in which the plurality of head units 111 overlap in a head-unit array direction X thereof when viewed from a sheet ejection side, a sheet 13 is pressed between the feed roller 51*a* and the pressure roller 52 and additionally between the feed rollers 51*b* to 51*e* and the spurs 53*a* to 53*d*, respectively, as illustrated in FIG. 19. Thus, the sheet 13 can be prevented from floating toward the recording heads 11. Meanwhile, the sheet 13 is supported from below by the first ribs 41*a*, 41*b*, 41*c*, and 41*d*, and thus the distance between the sheet 13 and each head unit 111 can be kept substantially constant, thereby preventing a landing position deviation from occurring in the sheet conveyance direction Y.

Next, a sixth exemplary embodiment is described with reference to FIG. 20.

Figure 20:
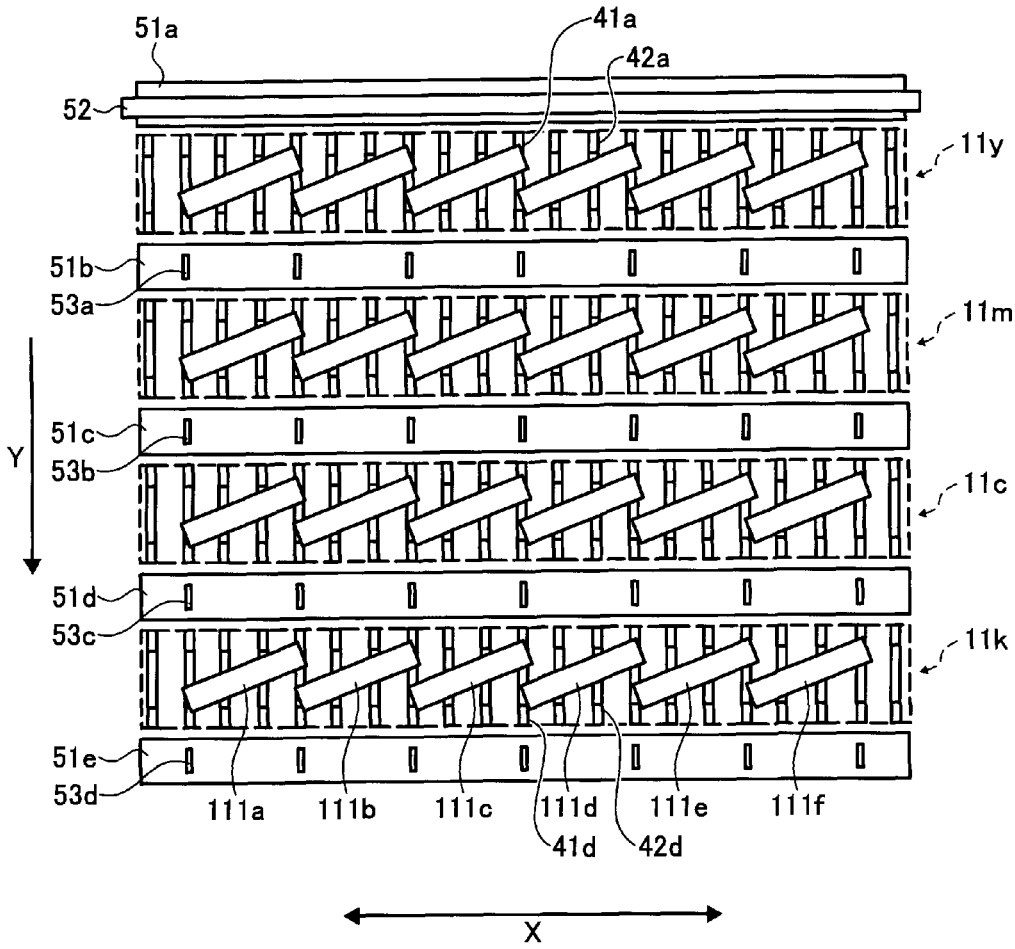
FIG. 20 is a plan view illustrating a sixth exemplary embodiment.

FIG. 20 is a plan view illustrating the sixth exemplary embodiment. The sixth exemplary embodiment of FIG. 20 has a configuration substantially identical to the fifth exemplary embodiment of FIG. 18 except that the staggered-array recording heads 11*y*, 11*m*, 11*c*, and 11*k* of FIG. 18 are replaced with inclined-array recording heads 11*y*, 11*m*, 11*c*, and 11*k*, respectively in FIG. 20.

In such a configuration as well, in areas in which adjacent ones of a plurality of head units 111 overlap in a head-unit array direction X thereof when viewed from a sheet ejection side, a sheet 13 is pressed between the feed roller 51*a* and the pressure roller 52 and additionally between the feed rollers 51*b* to 51*e* and the spurs 53*a* to 53*d*, respectively. Thus, the sheet 13 can be prevented from floating toward the recording heads 11. Meanwhile, the sheet 13 is supported from below by the first ribs 41*a*, 41*b*, 41*c*, and 41*d* and thus the distance between the sheet 13 and each head unit 111 can be kept substantially constant, thereby preventing a landing position deviation from occurring in the sheet conveyance direction Y.

Next, a seventh exemplary embodiment is described with reference to FIG. 21.

Figure 21:
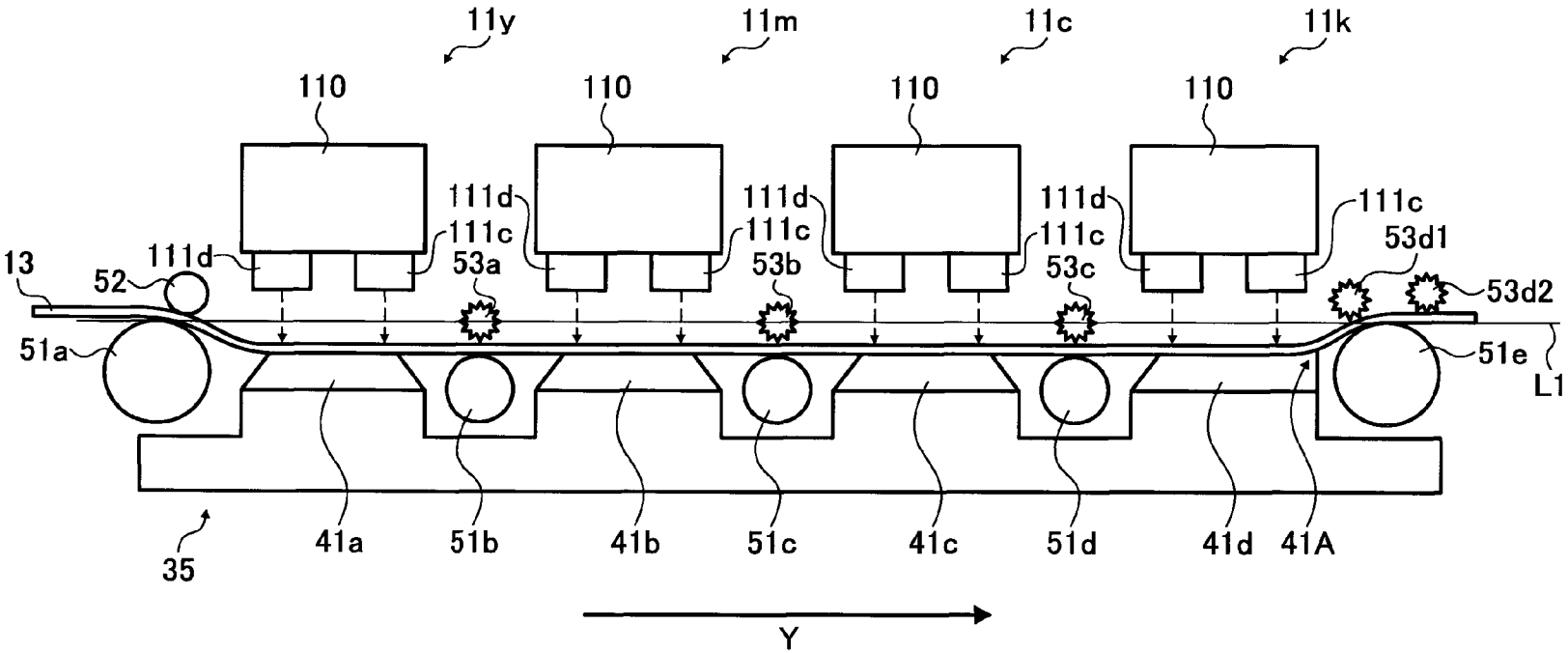
FIG. 21 is a sectional view illustrating a seventh exemplary embodiment.

FIG. 21 is a sectional view illustrating the seventh exemplary embodiment. In FIG. 21, feed rollers 51*a*, 51*b*, 51*c*, 51*d*, and 51*e* are disposed opposite a pressure roller 52 and spurs 53*a*, 53*b*, 53*c*, 53*d*1, and 53*d*2 on upstream and downstream sides of respective recording heads 11*y*, 11*m*, 11*c*, and 11*k* in a sheet conveyance direction Y.

The feed rollers 51*a* and 51*e* provided on the extreme upstream and downstream sides, respectively, in the sheet conveyance direction Y are disposed so as to support the sheet 13 from below at higher positions than first ribs 41 of a platen guide 35, which are the higher of the two types of ribs. In other words, the top faces of the first ribs 41 are disposed at positions lower than an imaginary line L1 connecting the highest points of the feed roller 51*a* and the feed roller 51*e*.

The pressure roller 52 is disposed opposite the feed roller 51*a* to push the sheet 13 down so as to move the sheet 13 along the top faces of the first ribs 41.

In such a configuration, the spurs 53*d*1 and 53*d*2 are disposed opposite the feed roller 51*e* on the extreme downstream side so as to reliably move the sheet 13 along a peripheral surface of the feed roller 51*e*. The remaining feed rollers 51*b* to 51*d* are provided between the recording heads 11 so as to support the sheet 13 from below at substantially the same level as each top surface of the first ribs 41 of the platen guide 35.

The spurs 53*a* to 53*d* are disposed at positions corresponding to areas in which a plurality of head units 111 overlap in an array direction X thereof. In the platen guide 35, the first ribs 41*a* to 41*d* and second ribs 42*a* to 42*d*, not illustrated in FIG. 21, are disposed only directly below the recording heads 11*y*, 11*m*, 11*c*, and 11*k*. As illustrated in FIG. 21, each first rib 41*d* on the extreme downstream side in the sheet conveyance direction Y has an inclined face 41A sloping up toward an upper portion of the feed roller 51*e*. Each second rib 42*d*, not illustrated, also has a similar inclined face sloping up toward an upper portion of the feed roller 51*e*.

Such configuration allows the sheet 13 to be pressed against the first ribs 41*a* with greater force, thus more reliably preventing the sheet 13 from floating toward the recording head 11. Accordingly, the distance between each head unit 111 and the sheet 13 is kept substantially constant, thereby preventing a landing position deviation from occurring in the sheet conveyance direction Y.

Next, an eighth exemplary embodiment is described with reference to FIG. 22.

Figure 22:
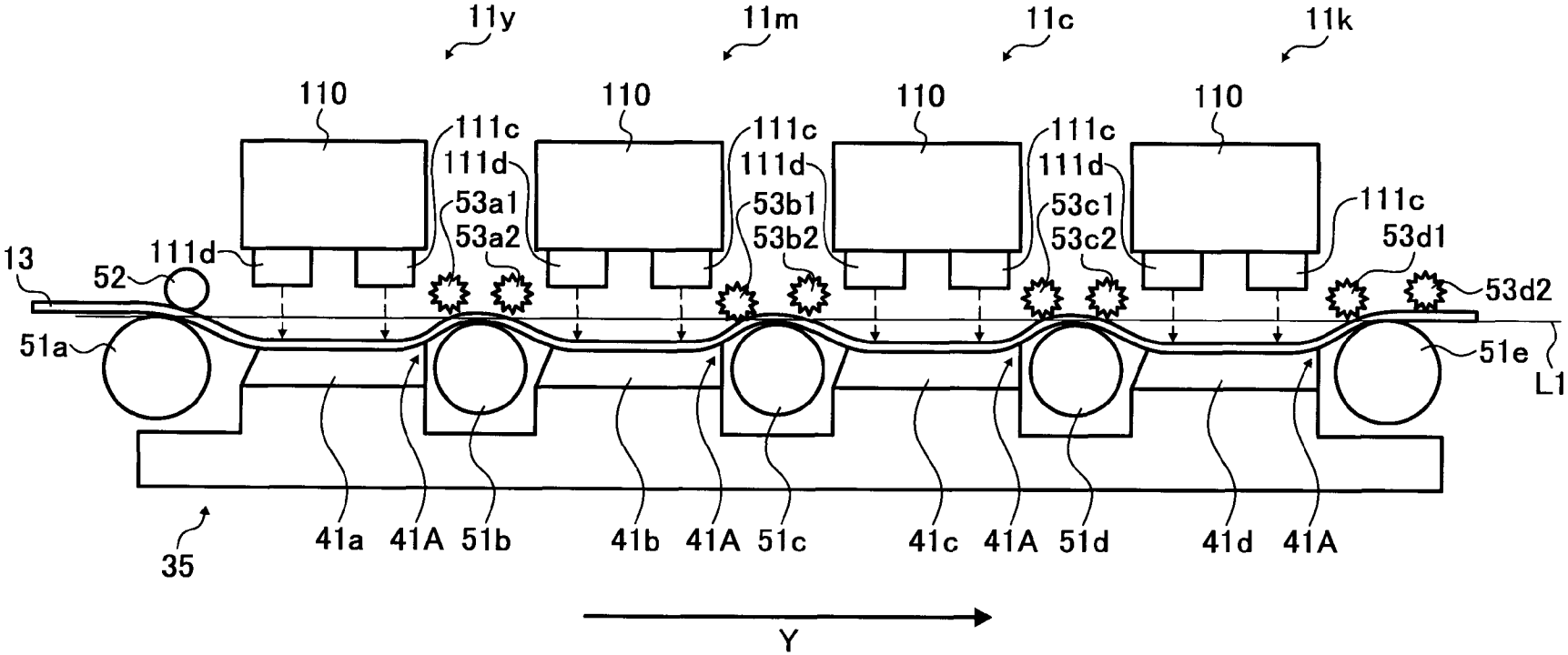
FIG. 22 is a sectional view illustrating an eighth exemplary embodiment.

FIG. 22 is a sectional view of the eighth exemplary embodiment. In FIG. 22, feed rollers 51*a*, 51*b*, 51*c*, 51*d*, and 51*e* are disposed opposite a pressure roller 52 and spurs 53*a*1, 53*a*2, 53*b*1, 52*b*2, 53*c*1, 53*c*2, 53*d*1, and 53*d*2 on upstream and downstream sides of respective recording heads 11*y*, 11*m*, 11*c*, and 11*k* in a sheet conveyance direction Y.

In addition to the feed rollers 51*a* and 51*e* provided on the extreme upstream and downstream sides, respectively, in the sheet conveyance direction Y, the feed rollers 51*b*, 51*c*, and 51*d* are provided between the respective recording heads 11 so as to support a sheet 13 from below at higher positions than first ribs 41 of a platen guide 35, which are the higher of the two types of ribs. The pressure roller 52 is disposed opposite the feed roller 51*a* to push down the sheet 13 so as to move along the top faces of the first ribs 41.

The two spurs 53*d*1 and 53*d*2 are disposed opposite the feed roller 51*e* on the extreme downstream side so as to reliably move the sheet 13 along a peripheral surface of the feed roller 51*e*. Further, respective pairs of spurs 53*a*1 and 53*a*2, 53*b*1 and 53*b*2, and 53*c*1 and 53*c*2 are disposed opposite the feed rollers 51*b*, 51*c*, and 51*d*, respectively, so as to reliably move the sheet 13 along peripheral surfaces of the feed rollers 51*b* to 51*d*.

The spurs 53*a*1 to 53*d*2 are disposed at positions corresponding to areas in which a plurality of head units 111 overlap in a head-unit array direction thereof. In the platen guide 35, the first ribs 41*a* to 41*d* and second ribs 42*a* to 42*d*, not illustrated, are disposed only directly below the recording heads 11*y*, 11*m*, 11*c*, and 11*k*. As illustrated in FIG. 22, the first ribs 41*a* to 41*d* disposed directly below each recording heads 11 have inclined faces 41A sloping up toward respective upper portions of the feed rollers 51*b* to 51*e*. The second ribs 42*a* to 42*d* also have similar inclined portions, not illustrated, sloping up toward respective upper portions of the feed rollers 51*b* to 51*e*.

As described above, each of the first and second ribs 41 and 42 is formed to have an inclined portion smoothly sloping up toward one end thereof. As a result, the sheet 13 can be smoothly conveyed, thereby preventing image degradation such as banding from occurring when the sheet 13 is brought into contact with the feed rollers 51*a* to 51*e*.

Next, a ninth exemplary embodiment is described with reference to FIGS. 23 and 24.

Figure 23:
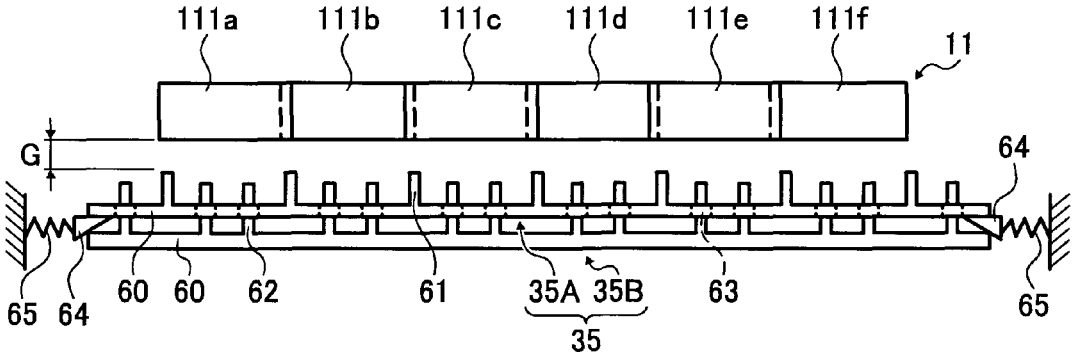
FIG. 23 is a schematic view illustrating a ninth exemplary embodiment viewed from a sheet ejection side.

FIG. 23 is a schematic view illustrating the ninth exemplary embodiment viewed from a sheet ejection side. FIG. 24 is a schematic view illustrating an operation of the ninth exemplary embodiment of FIG. 23.

In FIG. 23, a platen guide 35 includes a first guide segment 35A and a second guide segment 35B. The first guide segment 35A has first ribs 61, and the second guide segment 35B has second ribs 62. The first guide segment 35A is fixed whereas the second guide segment 35B is vertically movable, such that the second ribs 62 thereof pass through holes 63 of the first guide segment 35A.

Figure 24:
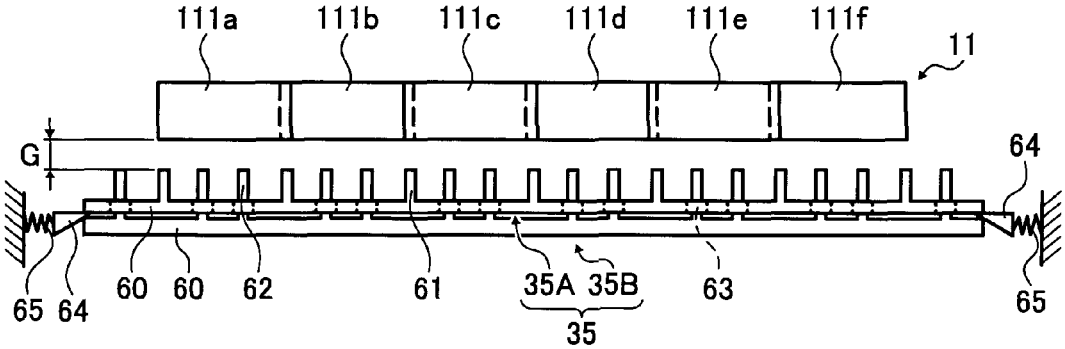
FIG. 24 is a schematic view illustrating an operation of the exemplary embodiment of FIG. 23.

In such a configuration, when the second guide segment 35B is moved upward as illustrated in FIG. 24, the second ribs 62 of the second guide segment 35B can be maintained at a height substantially identical to the first ribs 61 of the first guide segment 35A. In other words, the gap between the second guide segment 35B and the recording head 11 becomes substantially identical to the gap G between the first guide segment 35B and the recording head 11. The first ribs 61 of the first guide segment 35A are disposed at positions corresponding to areas in which adjacent head units 111 overlap in a head-unit array direction thereof.

Elevating members 64 having a wedge shape are disposed so as to intervene between the first guide segment 35A and the second guide segment 35B. Each elevating member 64 is biased by an elastic member 65 such as a spring in such a direction that the first guide segment 35A and the second guide segment 35B are separated from each other. Further, another member, not illustrated, is provided to approach or raise the second guide segment 35B toward the first guide segment 35A while moving each elevating member 64 in a direction opposite the direction in which each elevating member 64 is biased by the elastic member 65.

Thus, as illustrated in FIG. 23, when the second guide segment 35B descends relative to the first guide segment 35A, the top faces of the second ribs 62 are positioned lower than the top faces of the first ribs 61 of the first guide segment 35A. In such a state, the platen member 35 is formed of the higher first ribs 61 and the lower second ribs 62.

As a result, similar to the above-described exemplary embodiments, even if cockling occurs on a sheet, in areas in which the sheet is supported by the higher first ribs 61, the sheet can be prevented from floating toward the recording head 11 or shifting in a direction substantially perpendicular to a sheet conveyance direction. Further, in areas in which adjacent head units 111 overlap in a head-unit array direction, the sheet can be prevented from floating and sinking due to swelling. As a result, fluctuation in the gap between the sheet and each recording head 11 can be suppressed. Thus, similar to when cockling does not occur in the sheet conveyance direction, landing position deviation can be prevented from occurring in the sheet conveyance direction, thereby suppressing degradation in image quality.

By contrast, as illustrated in FIG. 24, when the second guide segment 35B ascends relative to the first guide segment 35A, the top faces of the first ribs 61 of the first guide segment 35A are positioned at a height substantially identical to the top faces of the second ribs 62 of the second guide segment 35B. In this state, the platen guide 35 is formed of the first ribs 61 and the second ribs 62, which are substantially identical in height at the respective top faces.

Thus, when using a thick sheet resistant to cockling, for example, a gloss paper sheet, such adjustment of rib height can prevent image degradation due to deformation of the sheet.

With such a mechanism for adjusting the rib height of the platen member, images of superior quality can be reliably obtained on sheets of any media subject to or resistant to cockling.

Further, as described above, the guide member, configured as the platen guide in FIGS. 23 and 24, includes a first guide segment and a second guide segment each having ribs. In the guide member, the first and second guide segments are vertically movable relative to each other. In such a configuration, the positions of the ribs of the first and second guide members relative to the recording head can be changed with the position of the first member relative to the second member. Thus, the heights of the ribs of the guide member can be adjusted in a relatively simple configuration.

Numerous additional modifications and variations are possible in light of the above teachings. It is therefore to be understood that, within the scope of the appended claims, the disclosure of this application may be practiced otherwise than as specifically described herein.

Further, elements and/or features of different exemplary embodiments and/or examples may be combined with each other and/or substituted for each other within the scope of this disclosure and appended claims.

What is claimed is:

1. An image forming apparatus, comprising:

a recording head including a plurality of head units to discharge liquid droplets onto a recording medium, each of the plurality of head units having a plurality of nozzles through which liquid droplets are discharged;

a conveyance member to convey the recording medium in a conveyance direction substantially perpendicular to a head-unit array direction in which the plurality of head units are arranged; and a guide member including a plurality of ribs of at least two, first and second, types having different heights, the guide member being disposed opposite and below the recording head so as to guide the recording medium, wherein the first type of ribs having a height greater than a height of the second type of ribs are disposed opposite and below areas where the plurality of head units overlap in the head-unit array direction, wherein each rib of the plurality of ribs of the guide member disposed below the recording head has a top end and a bottom end, with the top end being closer than the bottom end to the recording head, wherein the top end of a rib of the first type is closer than the top end of a rib of the second type to the recording head, and wherein the first type of ribs and the second type of ribs are formed in parallel to a direction perpendicular to a direction in which the plurality of nozzles is arranged in line in each of the plurality of head units.

2. The image forming apparatus according to claim 1, wherein the plurality of head units are staggered.

3. The image forming apparatus according to claim 1, wherein the plurality of head units are inclined with respect to the arranged direction thereof.

4. The image forming apparatus according to claim 1, wherein the guide member further includes a plurality of slits at areas opposite the plurality of nozzles in each of the plurality of head units.

5. The image forming apparatus according to claim 4, further comprising a waste liquid receiver disposed below the plurality of slits to receive droplets drained through the plurality of slits.

6. The image forming apparatus according to claim 1, further comprising a plurality of pressing members to press the recording medium, wherein the plurality of pressing members are disposed on upstream and downstream sides of the recording head in the conveyance direction of the recording medium so as to be in line with the areas where the plurality of head units overlap in the arranged direction thereof.

7. The image forming apparatus according to claim 6, wherein each of the plurality of pressing members is disposed on a straight line extending in a long direction of the first type of ribs.

8. The image forming apparatus according to claim 6, wherein the pressing members are spurs and feed rollers to sandwich the recording medium at a substantially same height as a height of an upper face of the first type of ribs.

9. The image forming apparatus according to claim 1, further comprising a pressing member disposed opposite the conveyance member on an upstream side of the recording head, wherein the conveyance member conveys the recording member while supporting the recording medium at a position higher than the first type of ribs of the guide member, and the pressing member presses the recording medium down toward the guide member.

10. The image forming apparatus according to claim 1, wherein the guide member is capable of adjusting heights of the plurality of ribs relative to the recording head.

11. The image forming apparatus according to claim 10, wherein the guide member includes a first segment and a second segment vertically movable relative to each other, wherein the first segment includes the first type of ribs and the second segment includes the second type of ribs, and wherein heights of the first type of ribs and the second type of ribs relative to the recording head are adjustable by changing positions of the first segment and the second segment relative to the recording head.

12. The image forming apparatus according to claim 1, further comprising spurs and feed rollers to sandwich the recording medium at a substantially same height as a height of the top end of the ribs of the first type, and wherein the spurs are aligned with the areas where the plurality of head units overlap in the head-unit array direction.

13. The image forming apparatus according to claim 1, wherein the ribs of the second type are disposed opposite and below areas of the plurality of head units where the plurality of head units does not overlap with each other.

* * * * *